US005553361A

United States Patent [19]

Tacchetto et al.

[11] Patent Number: 5,553,361

[45] Date of Patent: Sep. 10, 1996

[54] FASTENING DEVICE FOR SPORTS SHOES

[75] Inventors: Maurizio Tacchetto, Villa D'Asolo; Mirco Battistella, Spresiano, both of Italy

[73] Assignee: Nordica S.p.A., Trevignano, Italy

[21] Appl. No.: 398,016

[22] Filed: Mar. 3, 1995

[30] Foreign Application Priority Data

Mar. 16, 1994 [IT] Italy ..... TV94A0033

[51] Int. Cl.[6] ..... A43C 11/14

[52] U.S. Cl. ..... 24/68 SK; 16/124; 36/50.5

[58] Field of Search ..... 24/68 SK, 69 SK, 24/70 SK, 71 SK; 16/110 A, 124; 36/50.5, 117, 121, 120

[56] References Cited

U.S. PATENT DOCUMENTS 2,222,320 11/1940 Morgan ..... 16/124 X
3,401,432 9/1968 Tresenreiter .
4,951,364 8/1990 Marega .

FOREIGN PATENT DOCUMENTS 0542339 5/1993 European Pat. Off. .
1813106 7/1969 Germany .
8002933 8/1980 Germany .
1219078 1/1971 United Kingdom ..... 16/110 A

*Primary Examiner*—James R. Brittain
*Attorney, Agent, or Firm*—Guido Modiano; Albert Josif

[57] ABSTRACT

A fastening device for sports shoes, such as ski boots or skates. The device comprises a plastic body and a metal element which constitutes a containment frame for the plastic body. The metal element can thus be interlocked with the plastic body, so as to obtain a device that has high stress resistance despite having a low weight and cost.

11 Claims, 3 Drawing Sheets

FASTENING DEVICE FOR SPORTS SHOES

BACKGROUND OF THE INVENTION

The present invention relates to a fastening device for sports shoes, such as for example ski boots or skates.

Several fastening devices for ski boots are currently known: Italian patent no. 821919, filed on Dec. 16, 1967 discloses a tensioning lever for closing ski boots which is characterized by a metal core covered on all sides by plastics that can be applied by injection-molding or by molding.

However, in the effort of reducing manufacturing costs, this solution has shown some drawbacks: the considerable reduction of the metal portion by injecting plastics over it, has undoubtedly weakened the overall structure of the lever, whose portion made of plastics can break and/or warp in case of accidental impacts.

The portion made of plastics is in fact directly affected by impacts because it surrounds the metal portion.

Furthermore, the two components may disengage from each other, consequently causing possible deformation of the lever during closure.

Italian patent no. 843875, filed on Sep. 24, 1968 discloses a fastening lever made of plastics which is characterized in that a profiled metal bar is provided on the upper part of the fastening lever and runs longitudinally along the lever. The bar is rigidly associated with the portion made of plastics of the lever and is arranged so that at least the upper part of the profile is external and visible.

The profiled metal bar is substantially U-shaped and merely serves to strengthen the portion made of plastics; it can be considered equivalent to a longitudinal rib which cannot cooperate effectively with the plastics to increase the strength of the lever due to its small extension and cross-section.

Accordingly, any accidental impact, which usually occurs laterally with respect to the lever, affects only the portion made of plastics, which is accordingly intrinsically subject to breaking.

Italian patent Application no. 41524 A/79, dated Feb. 28, 1979 discloses an improvement in the construction of fastening levers used in ski boots which substantially uses a U-shaped tempered steel blade which is inserted at an adapted channel formed on a portion made of plastics.

This solution, too, has drawbacks: as the two elements are practically both U-shaped and mutually superimposed to obtain the lever, the portion made of plastics may disengage from the metal one due to accidental impacts. On one hand this makes it difficult to activate the lever, and on the other hand the metal portion may break or deform, with the consequent need to replace the entire lever.

When opening the lever, the user also applies a considerable stress to the portion made of plastics, which can disengage from the metal portion.

U.S. Pat. No. 4,951,364 discloses a locking lever for ski boots which is substantially constituted by a metal portion having side walls covered with plastics.

In this solution, however, the functionality of the lever is provided exclusively by the metal portion, whereas the portions made of plastics have a merely aesthetic function, without thus increasing the strength of the lever in any way.

European patent application EP 542339 discloses a closure and engagement lever for ski boots which has a central body made of plastics with lateral portions made of metal.

However, even this solution, which is similar to the previously described one, has drawbacks: the metal portion absorbs all lateral impacts and transmits them directly and fully to the portion made of plastics, which may break.

Furthermore, as the lateral metal portions are not directly connected to each other, torsion stress may be produced during the closing or opening of the lever, leading to accidental breakages.

SUMMARY OF THE INVENTION

The aim of the present invention is to solve the described technical problems, eliminating the drawbacks of the prior art, by providing a fastening device which is highly resistant to stress despite its low weight and manufacturing costs.

Within the scope of this aim, an important object is to provide a fastening device which, despite being formed by two components, can continue to perform the required function even if one of the two components breaks without causing the collapse of the entire structure.

Another object is to provide a device that is structurally simple as well as effective and safe in use.

This aim, these objects, and others which will become apparent hereinafter are achieved by a fastening device for sports shoes, particularly for ski boots or skates, comprising a plastic body and a metal element, characterized in that said metal element constitutes a containment frame for said plastic body, said metal element having guiding means, centering means and locking means for said plastic body which are adapted to allow mutual interpenetration.

BRIEF DESCRIPTION OF THE DRAWINGS

Further characteristics and advantages of the invention will become apparent from the detailed description of some particular but not exclusive embodiments, illustrated only by way of non-limitative example in the accompanying drawings, wherein.

DESCRIPTION OF THE PREFERRED EMBODIMENTS

Figure 2:
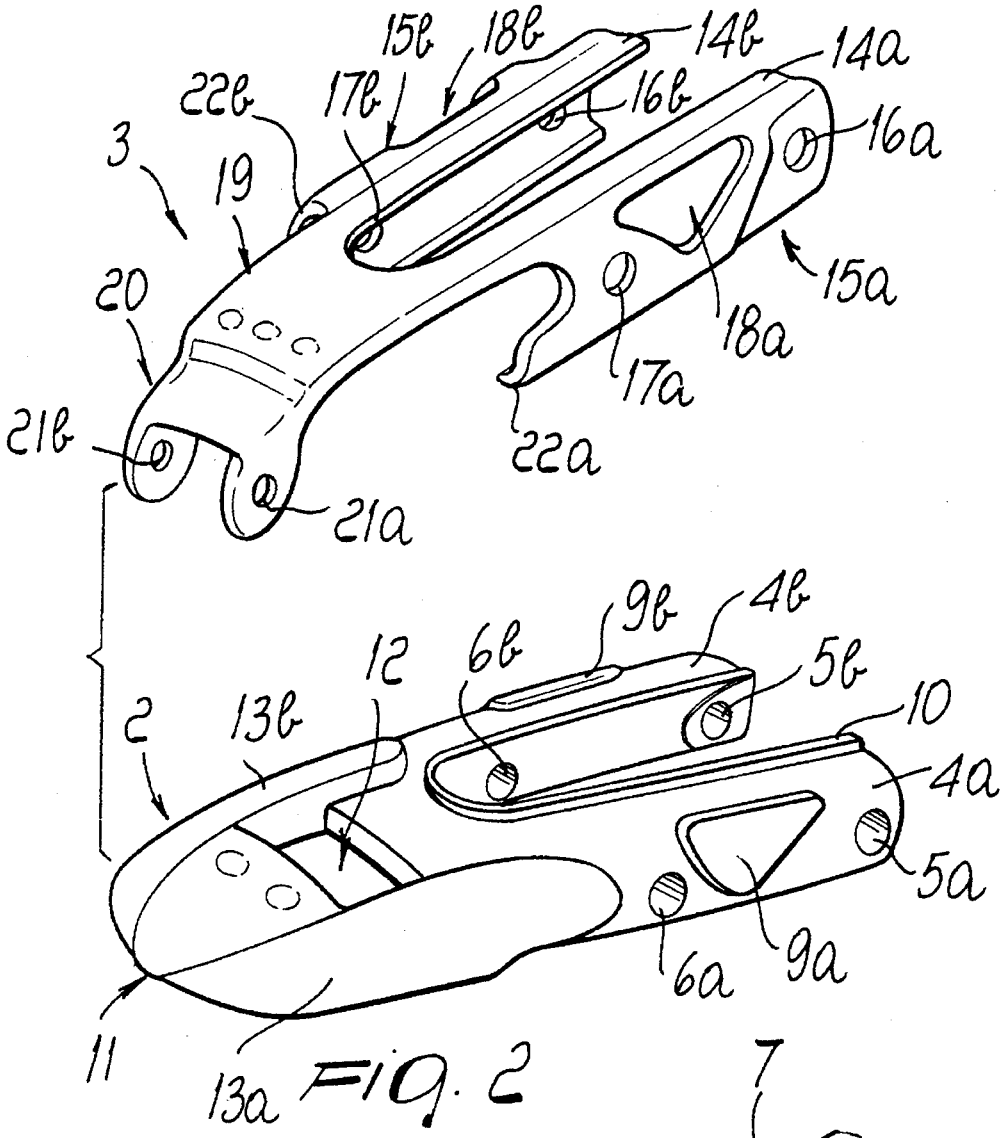
FIG. 2 is an exploded perspective view of the device of FIG. 1.

With reference to the above figures, the reference numeral 1 designates the fastening device, which is applied particularly in sports shoes such as ski boots or skates.

Said device comprises a plastic body 2 and an element 3 made of metal.

In the particular illustrated embodiment, the plastic body 2 is essentially U-shaped, forming first wings **4*a* and 4*b* in which a first pair of through holes 5*a* and 5*b* and a second pair of through holes 6*a* and 6*b*** are formed.

If the device is used as a lever arm, then at least one pivot can be located at the first pair of through holes **5*a* and 5*b* to allow the pivoting of a pair of brackets. The brackets protrude from a base that can be rigidly coupled to a flap to be joined. At the second pair of through holes 6***a* and 6*b*, it is possible to associate another anchoring pivot, for example for a tensioner 7, such as a rigid or flexible traction element, which interacts at one end with adapted means that can be associated with the other flap to be joined.

Said plastic body 2 also has, at the surfaces of the first wings 4*a* and 4*b* that do not face each other, first raised portions 9*a* and 9*b* which protrude therefrom externally and have a desired shape.

A ridge 10 protrudes at the surface of the plastic body 2 that does not face the flap of the sports shoe, at the first wings 4*a* and 4*b* and at the base surface that connects them, and is accordingly essentially U-shaped.

A first transverse through opening 12 is formed at the base 11 that connects the first wings 4*a* and 4*b* and preferably has a rectangular shape, in plan view.

A pair of first shoulders 13*a* and 13*b* is provided at the lateral ends of the first opening 12 on said base 11. The shoulders lie substantially longitudinally and also partially affect the lateral surfaces of said first wings 4*a* and 4*b*.

The metal element 3 has such a shape that it constitutes a containment frame for the plastic body 2. The metal element 3 is essentially U-shaped and has second wings 14*a* and 14*b* which are adapted to be arranged at the first wings 4*a* and 4*b* on which the ridge 10 is present. The ridge constitutes a means for mutually centering element 3 and body 2.

Each one of the second wings 14*a* and 14*b* has a first tab 15*a* and 15*b* which surrounds the lateral surfaces of the first wings 4*a* and 4*b* and part of their lower surfaces. A third pair of through holes 16*a* and 16*b* and a fourth pair of through holes 17*a* and 17*b* are provided on said first tabs and respectively have the same axes as the first pair of through holes 5*a* and 5*b* and as the second pair of through holes 6*a* and 6*b* once the body 2 and the element 3 have been mutually associated.

A pair of second openings 18*a* and 18*b* is formed on the first pair of tabs 15*a* and 15*b*. The openings are shaped complementary to the first raised portions 9*a* and 9*b* and constitute an element for centering and locking the metal element 3 on the plastic body 2.

The metal element 3 has a base 19 which connects the second wings 14*a* and 14*b*, and the width of said base is equal to the gap between the first shoulders 13*a* and 13*b* formed on the plastic body 2. A second tab 20 is provided at the end of said base 19 and can be inserted at the first opening 12; a fifth pair of through holes 21*a* and 21*b* is formed on the tip of said tab 20.

Said second tab 20 constitutes a means for guiding and centering the element 3 with respect to the body 2.

If the device must be used as an engagement element, for example for coupling to a rack, then a pivot adapted to be placed at the desired point of the rack is arranged at the fifth pair of through holes 21*a* and 21*b*, whereas connection to the tensioning element 7 can be provided at an adapted pivot that passes at the first pair of through holes 5*a* and 5*b*.

The second tab 20 and thus the fifth pair of through holes, 21*a* and 21*b* of course protrude below the base 11 of the plastic body 2.

The purpose of the pivots, placed in said through holes, is to act not only as rotation axis but also as means for mutually locking the body 2 and the element 3 to ensure permanent connection.

The metal element 3 also has additional means for centering and locking with respect to the body 2. The means comprises two third tabs 22*a* and 22*b* which protrude from the first tabs 15*a* and 15*b* towards the second tab 20 and are shaped complementary with respect to the tips of the first shoulders 13*a* and 13*b* that protrude from the plastic body 2.

The metal element 3 thus has structural functions, whereas the body 2 made of plastics has filler functions, with the characteristic that there is a mutual interpenetration, as the first raised portions 9*a* and 9*b* are arranged within the pair of second openings 18*a* and 18*b*, the second tab 20 is arranged within the first opening 12, and the pair of third tabs 22*a* and 22*b* interacts with the complementarily shaped first shoulders 13*a* and 13*b*.

This allows to ensure the overall integrity of the device if either the body 2 or the element 3 breaks and also to reduce the weight of said device by virtue of the hollows provided in the metal element 3.

Furthermore, the shape of the metal element may be optimized according to the specific applications of the device and thus, for example, according to the particular sport being practiced with the shoe to which it is to be coupled, in order to make the device more adapted to withstand stress.

Figure 1:
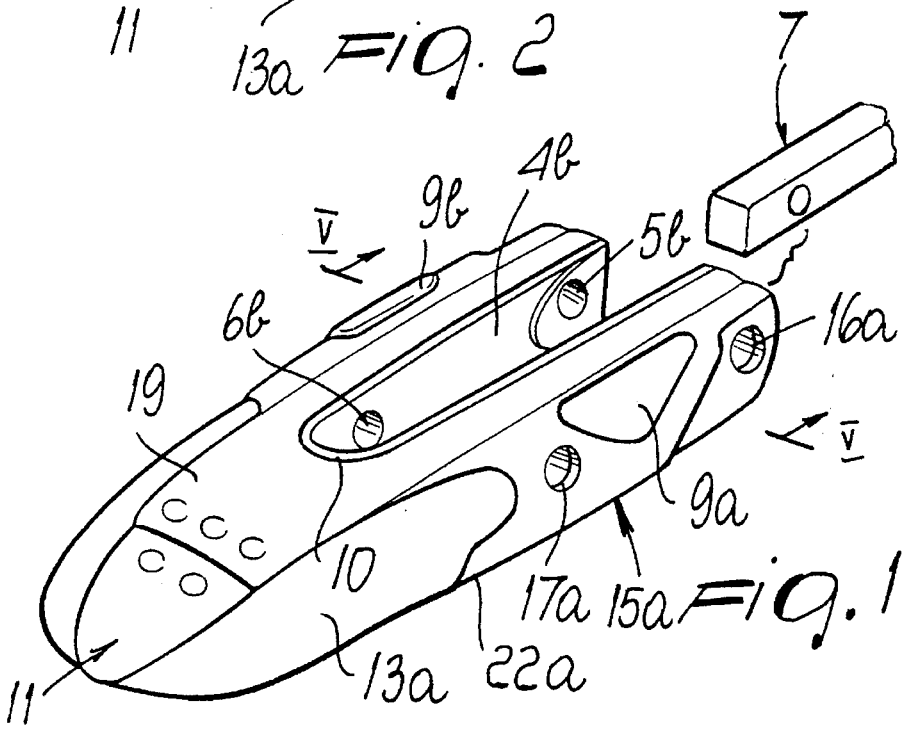
FIG. 1 is a lateral perspective view of the device.

It is in fact possible to use, for the metal element 3, a latticed frame-like shape which is more extreme than the one shown in FIGS. 1 and 2, so as to have a supporting structure whose configuration follows as closely as possible the directrices of the stresses that act on the fastening device.

It has thus been observed that the invention has achieved the intended aim and objects, a fastening device having been provided which acts as lever arm or as engagement element and allows to ensure high resistance to stress while maintaining low costs and weight.

Should the plastic body or the metal element break, the device continues to perform the required function without breaking down completely.

The fastening device according to the present invention is of course susceptible of numerous modifications and variations, all of which are within the scope of the same inventive concept.

Figure 4:
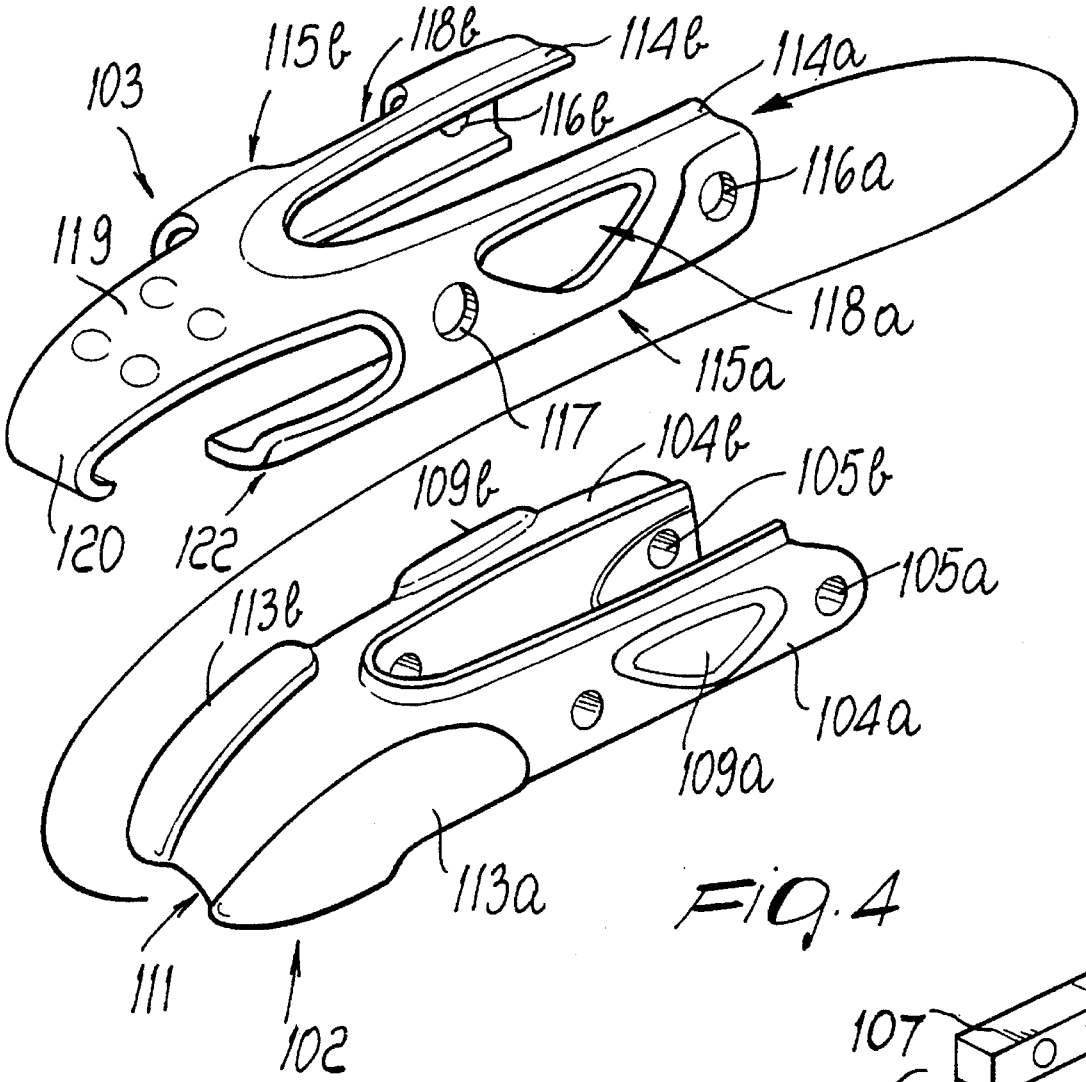
FIG. 4 is an exploded perspective view of the device of FIG. 3.
Figure 3:
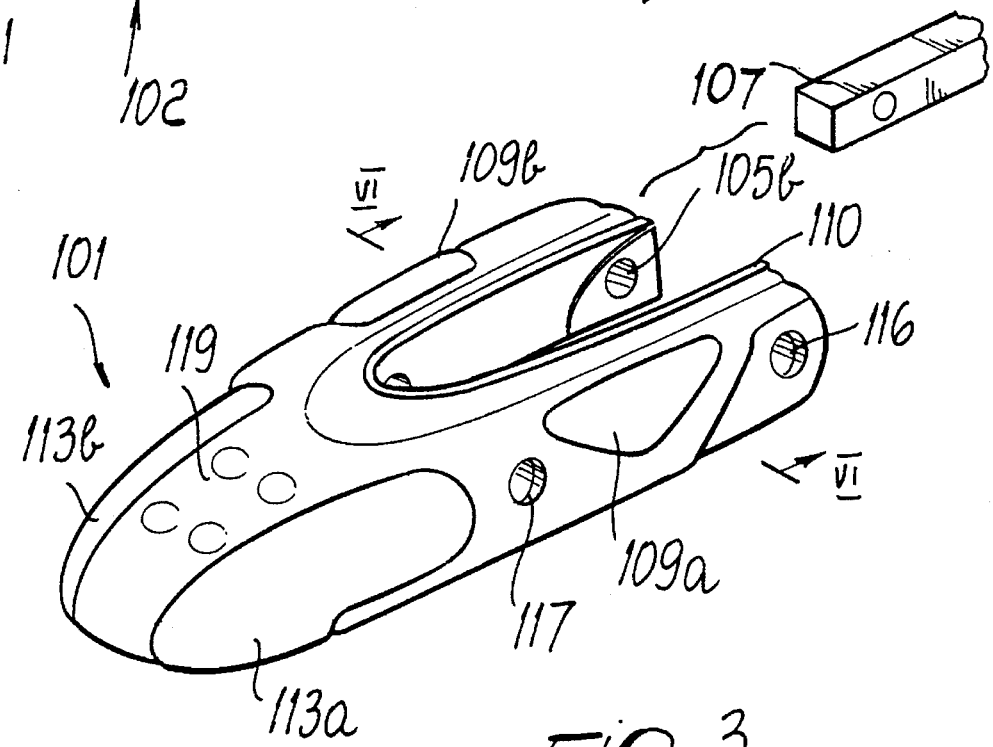
FIG. 3 is a lateral perspective view of a device according to a further aspect of the invention.
Figure 5:
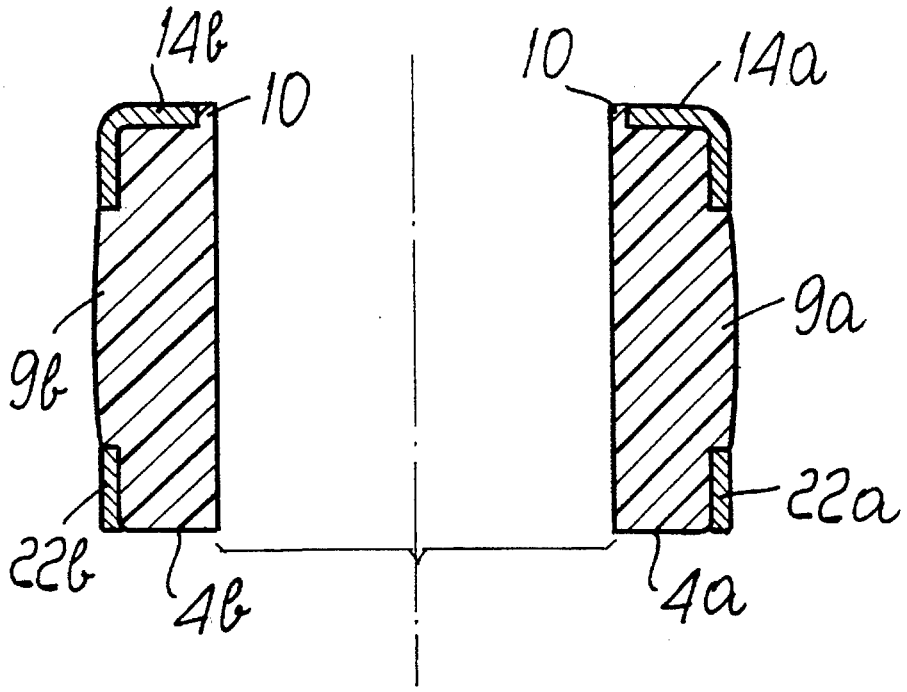
FIG. 5 is a sectional view, taken along the plane V–V of FIG. 1.
Figure 6:
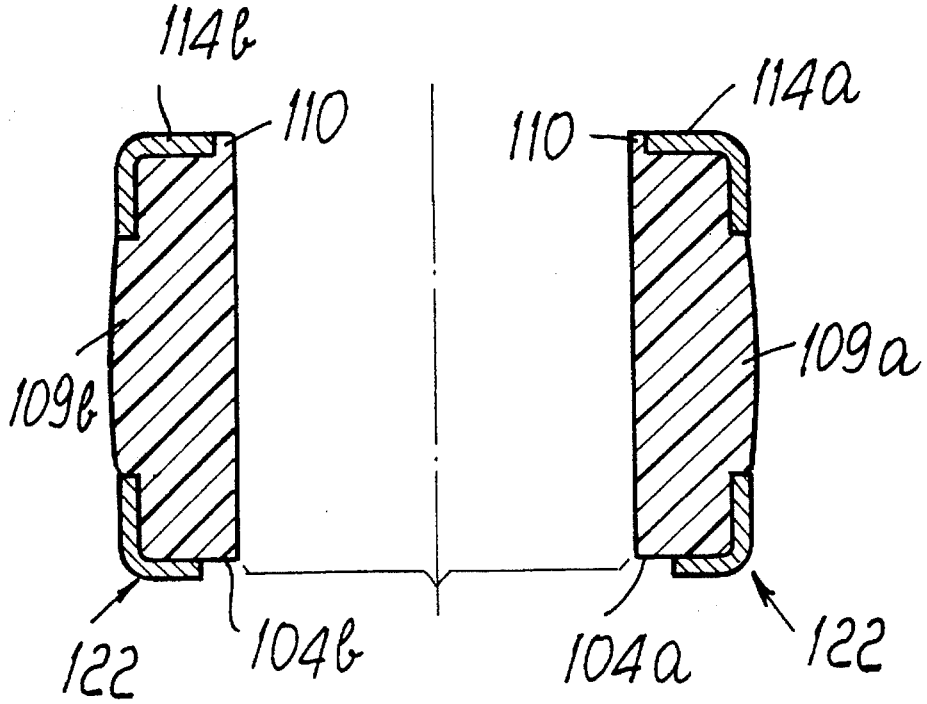
FIG. 6 is a sectional view, taken along the plane VI–VI of FIG. 3.

Thus, for example, FIGS. 3 and 4 illustrate a fastening device 101 which is constituted by a body 102 made of plastics and by a metal element 103. The body 102 is substantially U-shaped, so as to form first wings 104*a* and 104*b* on which a first pair of through holes 105*a* and 105*b* and a second pair of through holes 106*a* and 106*b* are provided.

If the device is used as a lever arm, then it is possible to place, at the first pair of through holes 105*a* and 105*b*, at least one pivot for a pair of wings that protrudes from a base that can be rigidly coupled to a flap to be joined, whereas at the second pair of through holes 106*a* and 106*b* it is possible to associate another anchoring pivot, for example for a tensioner 107 such as a rigid or flexible traction element which interacts at one end with adapted conventional means that can be associated with the other flap to be joined.

The plastic body 102 has first raised portions 109*a* and 109*b* at the surfaces of the first wings 104*a* and 104*b* that do not face each other. The first raised portions protrude externally and have a desired shape.

A ridge 110 protrudes at the surface of the plastic body 102 which does not face the flap of the sports shoes, at the first wings 104*a* and 104*b*, and at the base surface that connects said wings; said ridge is accordingly substantially U-shaped.

At the base 111, the plastic body 102 has first shoulders 113*a* and 113*b* which are arranged approximately longitudinally to it and partially affect the lateral surfaces of the first wings 104*a* and 104*b*.

The metal element 103 has such a shape as to constitute a containment frame for the plastic body 102. The metal element 103 is substantially U-shaped and thus has second wings 114*a* and 114*b* which are adapted to be arranged at the surfaces of the first wings 104*a* and 104*b* on which the ridge 110 is present; said ridge constitutes a means for mutually centering said element 102 and said body 103.

Each one of the second wings 114*a* and 114*b* has a first tab 115*a* and 115*b* that surrounds the lateral surfaces of the first wings 104*a* and 104*b* and part of their lower ones. A third pair of through holes 116*a* and 116*b* and a fourth pair of through holes 117 are formed on said tabs 115*a* and 115*b*, and said holes respectively have the same axes as the first pair of through holes 105*a* and 105*b* and as the second pair of through holes 106*a* and 106*b* once the body 102 and the element 103 have been mutually associated.

A pair of third tabs 122 is associated with the first pair of tabs 115*a* and 115*b* and constitutes means for centering and locking with respect to the body 102. The third tabs are shaped approximately complementarily to the first shoulders 113*a* and 113*b* and partially surround the plastic body 102 and under it.

A pair of second openings 118*a* and 118*b* is provided on said first pair of tabs 115*a* and 115*b* and is shaped complementarily to the first raised portions 109*a* and 109*b*. The pair of second openings constitutes an element for centering and locking the metal element 103 to the plastic body 102.

The metal element 103 has a base 119 for mutually connecting the second wings 114*a* and 114*b*; the width of said base is equal to the gap between the first shoulders 113*a* and 113*b* formed on the plastic body 102.

At the base 119 of the metal element 103 there is also a second substantially hook-like tab 120 which is shaped complementarily to the base 111 of the plastic body 102 and can be arranged, like the base 119, in the gap between the first shoulders 113*a* and 113*b*.

Said second tab 120, which constitutes a means for guiding and centering the element 103 with respect to the body 102, also partially affects the lower surface of the plastic body 102.

Differently from the previously described solution, the plastic body 102 is inserted from the rear at the metal element 103. The second wings 114*a* and 114*b* of the metal element can move elastically apart so as to allow to place the first raised portions 109*a* and 109*b* at the pair of second openings 118*a* and 118*b*.

With respect to the previous solution, this embodiment does not require an additional pivot for coupling to a rack if the device is used as an engagement element; this function is in fact performed by the second hook-shaped tab 120, which engages the rack directly.

This solution, too, allows to achieve the intended aim and objects. The materials and the dimensions that constitute the individual components of the device may of course be the most pertinent according to the specific requirements.

What is claimed is:

1. Fastening device for sports shoes, particularly for ski boots or skates, comprising;

a substantially U-shaped plastic body;

a substantially U-shaped metal element, said metal element constituting a containment frame for said plastic body, guiding means, centering means and locking means defined by said metal element, for mutual centering, interpenetration and interlocking of said plastic body and said metal element;

first wings defined by said plastic body, said first wings having lateral surfaces and lower surfaces;

a first pair of through holes and a second pair of through holes formed in said first wings;

second wings defined by said metal element and located adjacent said first wings defined by said plastic body;

first tabs each connected to one of said second wings and surrounding said lateral surfaces and partially surrounding said lower surfaces of said first wings;

a third pair of through holes and a fourth pair of through holes formed in said first tabs and being coaxial with respect to said first pair of through holes and said second pair of through holes formed in said first wings of said plastic body.

2. Fastening device according to claim 1, further comprising;

first raised portions formed on said plastic body;

a pair of second openings formed on said first pair of tabs and shaped complementarily with respect to said first raised portions, said pair of second openings constituting said locking means for mutual interlocking of said plastic body and said metal element.

3. Fastening device according to claim 2, wherein said plastic body is insertable into said metal element, said second wings of said metal element being mutually elastically movable apart for placement of said first raised portions at said two second openings.

4. Fastening device according to claim 1, further comprising;

first shoulders formed on said plastic body, a gap defined between said first shoulders, a base defined by said metal element, said base interconnecting said second wings and defining a base width, said base width base being equal to said gap defined between said first shoulders;

a first opening formed in said plastic body;

a second tab formed at said end of said base and being removably insertable in said first opening;

a tip defined by said second tab, and;

a fifth pair of through holes formed in said tip of said second tab.

5. Fastening device according to claim 4, wherein said second tab defines a means for guiding and centering said metal element with respect to said plastic body, said plastic body having a base, said second tab and said fifth pair of through holes protruding below said base of said plastic body.

6. Fastening device according to claim 4, further comprising;

a rack-engaging pivot selectively engageable with a rack and connected to said fifth pair of through holes formed on said second tab of said metal element, and;

a tensioner-engaging pivot connected to said first pair of through holes formed in said first wings of said plastic body.

7. Fastening device according to claim 6, wherein said metal element has additional means for centering and locking said metal element with respect to said plastic body, said additional means comprising two third tabs protruding from said first tabs of said metal element towards said second tab and being shaped complementarily with respect to said first shoulders of said plastic body.

8. Fastening device according to claim 7, wherein said two third tabs partially surround said plastic body, at a downward region thereof.

9. Fastening device according to claim 6, wherein said rack-engaging pivot and said tensioner-engaging pivot constitute means for locking said metal element to said plastic body.

10. Fastening device according to claim 4, wherein said plastic body has a base, and wherein said second tab is hook-shaped, said second tab being shaped complementarily with respect to said base of said plastic body and arrangeable in said gap defined between said first shoulders.

11. Fastening device according to claim 10, wherein said second tab constitutes a means for guiding and centering said metal element with respect to said plastic body and partially affects said plastic body at a lower surface thereof.

* * * * *